US005607364A

United States Patent [19]

Hedrick et al.

[11] Patent Number: 5,607,364

[45] Date of Patent: Mar. 4, 1997

[54] POLYMER DAMPED TUBULAR SHAFTS

[75] Inventors: Michael W. Hedrick; Douglas C. Winfield, both of Memphis, Tenn.

[73] Assignee: Black & Decker Inc., Newark, Del.

[21] Appl. No.: 361,141

[22] Filed: Dec. 21, 1994

[51] Int. Cl.[6] ..... A63B 53/12

[52] U.S. Cl. ..... 473/318

[58] Field of Search ..... 473/318, 319, 473/320, 321, 322, DIG. 23

[56] References Cited

U.S. PATENT DOCUMENTS

| | | | |
|---|---|---|---|
| 1,600,390 | 9/1926 | Barrett | 473/318 |
| 1,950,342 | 3/1934 | Meshel . | |
| 2,023,131 | 12/1935 | Gibson | 473/318 |
| 3,083,969 | 4/1963 | Bills, Jr. . | |
| 3,762,707 | 10/1973 | Santorelli . | |
| 4,084,819 | 4/1978 | Van Auken . | |
| 5,004,236 | 4/1991 | Kameshima . | |
| 5,083,780 | 1/1992 | Walton et al. . | |
| 5,288,070 | 2/1994 | Chen . | |
| 5,294,119 | 3/1994 | Vincent et al. . | |
| 5,297,791 | 3/1994 | Negishi . | |
| 5,316,300 | 5/1994 | Simmons . | |

FOREIGN PATENT DOCUMENTS

| | | |
|---|---|---|
| 540610 | 10/1941 | United Kingdom . |
| 2276859 | 10/1994 | United Kingdom . |

*Primary Examiner*—Sebastiano Passaniti

*Attorney, Agent, or Firm*—Harness, Dickey & Pierce, P.L.C.

[57] ABSTRACT

A golf club shaft including a damping layer which serves to reduce the amplitude of vibrational waves subject upon a golf club shaft is provided. The damping layer which includes, at least in part, an elastomeric material is coated to the inner diameter of the golf club shaft along a desired length. A method is also provided which relates to reducing the effects of induced modes of vibration upon a golf club shaft.

17 Claims, 5 Drawing Sheets

Fig-3
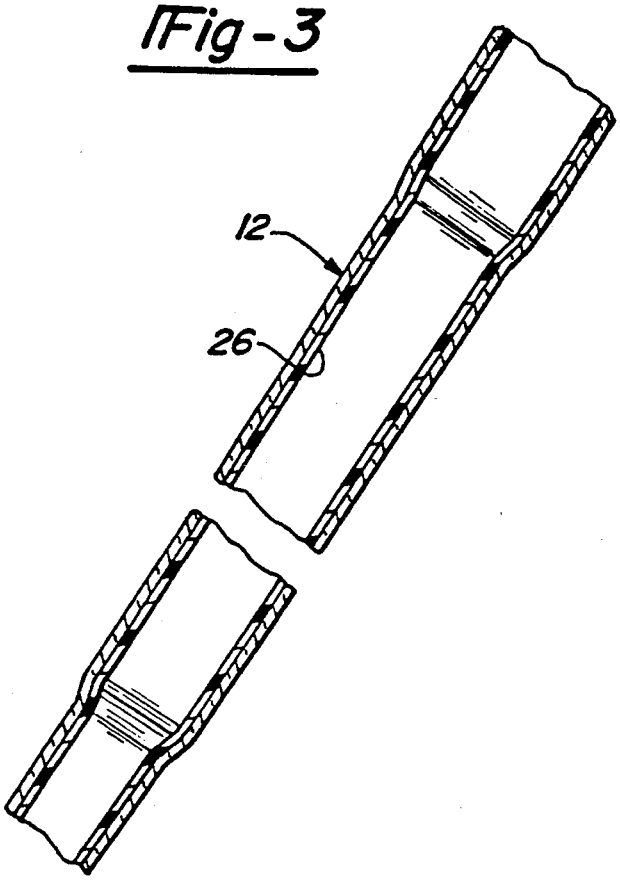
Fig-4
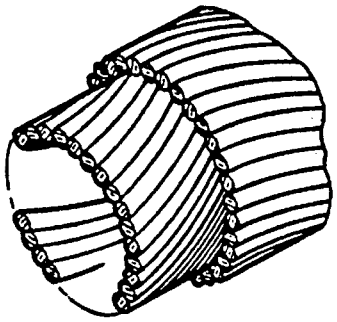
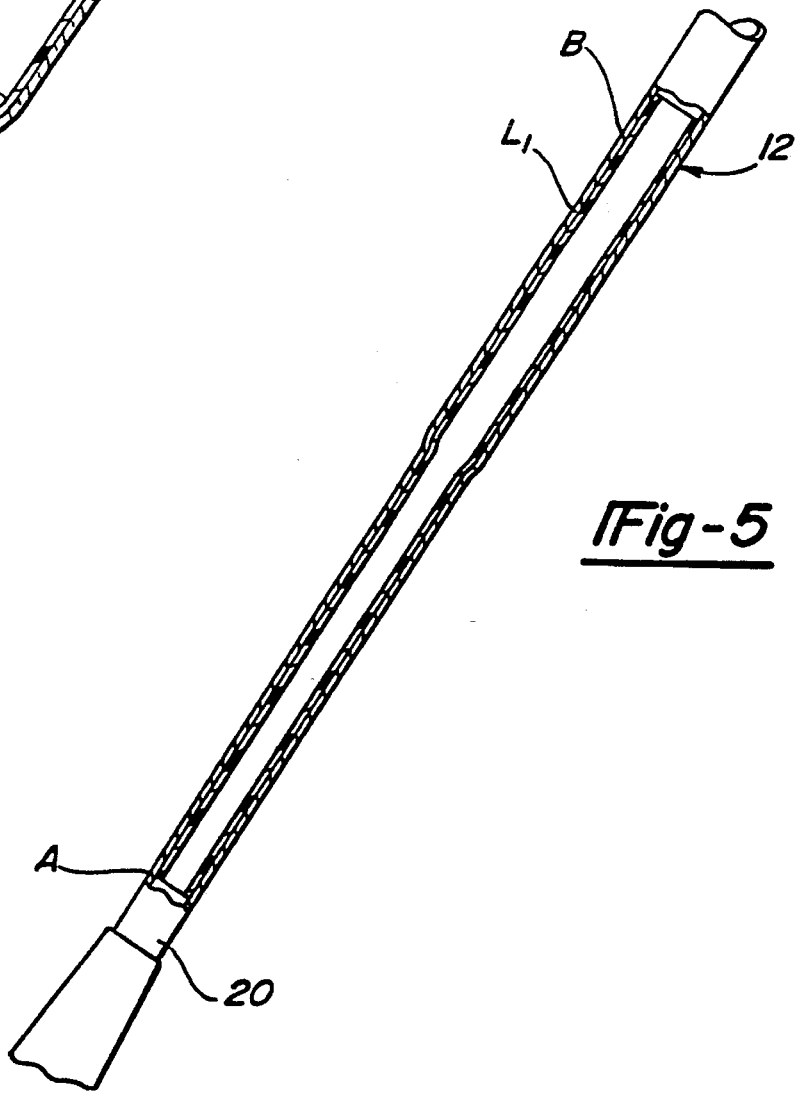
Fig-5

POLYMER DAMPED TUBULAR SHAFTS

BACKGROUND OF THE INVENTION

The present invention relates to shafts and, more particularly, to tubular shafts in which induced modes of vibration subjected upon the shafts are carefully controlled.

By way of example, one form of tubular shaft which is contemplated as on a golf club.

Golf clubs are typically assembled to include a club shaft having selected performance characteristics and a club head having matching or complementary performance characteristics. A number of factors must be considered in the design of the club head and the club shaft to assure optimal performance when hitting the golf ball. Many of the design factors for both the club head and the shaft are related to dimensional and static mass characteristics. For example, principal club head design parameters include the overall mass, the club face angle and surface characteristics, the dimensional envelope, and the location of the center of gravity. Similarly, principal club shaft design parameters include the length of the shaft, its diameter, the change in shaft diameter with length, the overall mass, and its flex characteristics.

Additionally, attention in the design and manufacture of golf club shafts has been focused on the flex and torsional damping characteristics of the golf club shaft since it has been discovered that the so-called damping characteristics have a direct and primary role in determining the "feel" of the golf club during impact.

With regard to use of the golf club, the golf club stroke can typically be divided into separately defined portions, namely the takeaway, the backswing, the downswing, impact, and the follow through. During the takeaway, the golf club is taken back to set up that portion of the swing generally known as the downswing somewhat to cause the club head to lag behind the shaft. As the downswing is initiated, the direction of the shaft movement and that of the club head is reversed with the club head lagging or following the shaft. The amount of club head lag is a function of the shaft stiffness and the torque applied to the shaft during downswing. Since the club head is on the distal end of the shaft during the downward acceleration, the club head accelerates more quickly than any other point along the shaft and, for most shafts, the club head will lead the shaft at some point in the downswing prior to impact. Because of the flexibility of the shaft, the club head has downswing flight characteristics somewhat akin to an object in tethered flight.

Among the consequences of these club head flight characteristics prior to impact are small changes in the angular relationships of the club face in relation to the longitudinal axis of the unflexed shaft. These angular changes affect the engagement of the club face with the ball at impact and, therefore, the subsequent flight path of the ball. During impact, the golf ball is compressed to define a contact area between the club face and the compressed surface of the golf ball through which a portion of the momentum of the club head is imparted to the ball. The time of actual contact between the club face and the golf ball is generally on the order of approximately 450 to 600 microseconds. As a result of the club head contacting the ball at impact, traverse and torsional vibrational waves are induced which travel upwardly along the length of the shaft toward the grip. For purposes of the present invention, "torsional vibration" is defined as the oscillatory displacement about the longitudinal axis of the shaft and "transverse vibration" is the oscillatory displacement occurring perpendicular to the longitudinal axis of the shaft.

As a consequence of the momentum transfer at the club face to the ball during impact, the shaft is flexed rearwardly so that the club head again lags behind and follows the shaft. After impact and during follow through, the club head oscillates between lagging and leading positions as a consequence of the natural frequencies of the shaft, these oscillations including several modal orders above the lowest order.

In an effort to enhance the "feel" of the golf club, golf shafts have been developed which are formed of composite fibers in which the shafts are fabricated from oriented non-metallic fibers, i.e., graphite, boron, glass, etc., in an epoxy matrix. For example, graphite shafts typically include an inner lamina fabricated with fibers that are oriented at complementary angles to the longitudinal axis of the unflexed shaft, e.g., +45° and −45°, to provide a measure of torsional stiffness, and an outer lamina fabricated with fibers that are substantially parallel to the longitudinal shaft axis to provide longitudinal stiffness. Typically, graphite shafts and composite shafts in general, have a somewhat "damped" feel wherein the effects of high vibrations along the shaft are less traumatic. The longitudinal stiffness can be controlled by varying the size and number of longitudinal fibers, and the torsional stiffness can be varied by controlling the angularly oriented fibers to provide a measure of independence between the two characteristics, sometimes it can be difficult.

In an effort to achieve a better "feel" still further developments in the art have focused on selectively damping golf club vibrations by controlling vibrational frequencies through the use of devices disposed along various lengths of the golf club shaft. Typically, such devices have included disposing sleeve-like members including a first layer of elastomeric material and a second layer of a metallic material about the inner or outer surface of the shaft as disclosed in U.S. Pat. No. 5,249,119 which issued Mar. 15, 1994, to Vincent et al.

The need for golf club shafts which offer isotropic material properties and which posses the internal damping characteristics seen, for example, in composite golf club shafts is readily apparent. By "isotropic," it is meant that the shaft to which the dampening material is applied will essentially have the same strength and elastic properties in all directions (i.e. similarities along the length of the shaft with regard to the modulus of elasticity, modulus of rigidity and Poisson' ratio). As a consequence of this isotropic effect, shafts and, more particularly, steel shafts are more consistent over a spectrum or set and allow for a tighter dispersion of shots.

SUMMARY OF THE INVENTION

In view of the above, it is the primary object of the present invention to provide a tubular shaft having means for damping the amplitude of vibrational waves generated thereon. It is another object of the present invention to provide methods for reducing the effects of induced modes of vibration upon such shafts.

In view of these objects, and others, the present invention provides tubular shafts with a layer of a relatively high dynamic torsional stiffness during torsional impact which is achieved through the use of a "damping layer." The golf club shaft may be made from a metal or metal alloy, or alternatively may be made from non-metal or composite materials. A viscoelastic film or "damping layer" is coated along a specified length of the golf club shaft's inner surface to effect a reduction in the intensity, i.e., the amplitude, of vibrational forces subjected upon the shaft. Essentially, the damping layer serves to increase the transverse and torsional damping characteristics.

In a first exemplary embodiment, a shaft is formed which is fabricated from a metal or metal alloy, such as steel, aluminum, or titanium, to provide a shaft having relatively high torsional stiffness. A viscoelastic damping layer is applied along a specified length of the inner surface of the shaft in order to utilize the cyclic deformation of the damping material which results from the vibration of the shaft, thus maximizing the energy dissipated per cycle. The damping layer can be positioned along specified segments of the shaft or along substantially the entire length of the shaft as desired.

In a second exemplary embodiment, a shaft is formed from a non-metallic or composite material, such as, for example, one which is fabricated from high-strength fiber layers oriented at some helix angle relative to the longitudinal axis of the shaft, i.e., +45° and −45°, to provide a shaft having a relatively high torsional stiffness. Again, a viscoelastic damping layer is applied along a specified length of the inner surface of the shaft.

Regardless of the golf club shaft embodiment employed, the shaft whether made from a metallic, non-metallic, composite or other such material will include specific stiffness characteristics along the length of the shaft. For example, some shafts may be stiffer toward the tip than others, while other shafts tend to be stiffer toward the butt end. The stiffness properties of the shafts are dependent on how the flexure modulus of the shaft varies along the length of the shaft. The flexural modulus is dependent on a number of factors, the shaft wall thickness and the diameter, among others. Thus, by varying the wall thickness and/or the diameter of the shaft in certain regions along the shaft, i.e. the butt or tip, the stiffness characteristic can be altered. By applying a damping layer along certain regions of the shaft additional effects on vibration damping may be effectuated.

The damping layer is formed from a viscoelastic material, such as a polymer having an average thickness of between approximately 0.02 inches to about 0.35 inches depending mainly upon the specific dimension of the golf club shaft and the material or materials from which it is made. The viscoelastic material absorbs energy as a function of the time versus magnitude characteristics of the impact profile.

Other objects and further scope of applicability of the present invention will become apparent from the detailed description to follow, taken in conjunction with the accompanying drawings, in which like parts are designated by like reference numerals and/or characters.

BRIEF DESCRIPTION OF DRAWINGS

FIG. 3 is a partial perspective, cross-sectional view of the shaft of FIG. 1 taken along line A—A illustrating a non-metallic golf club shaft including a viscoelastic damping layer disposed along the shaft's inner surface;

FIG. 4 is a blown up view of a section of the golf club shaft of FIG. 3;

FIG. 5 is a partial perspective, cross-sectional view of an alternative shaft embodiment illustrating a damping layer located along the lower end of the shaft;

DETAILED DESCRIPTION OF THE PREFERRED EMBODIMENT

Figures 1, 2:
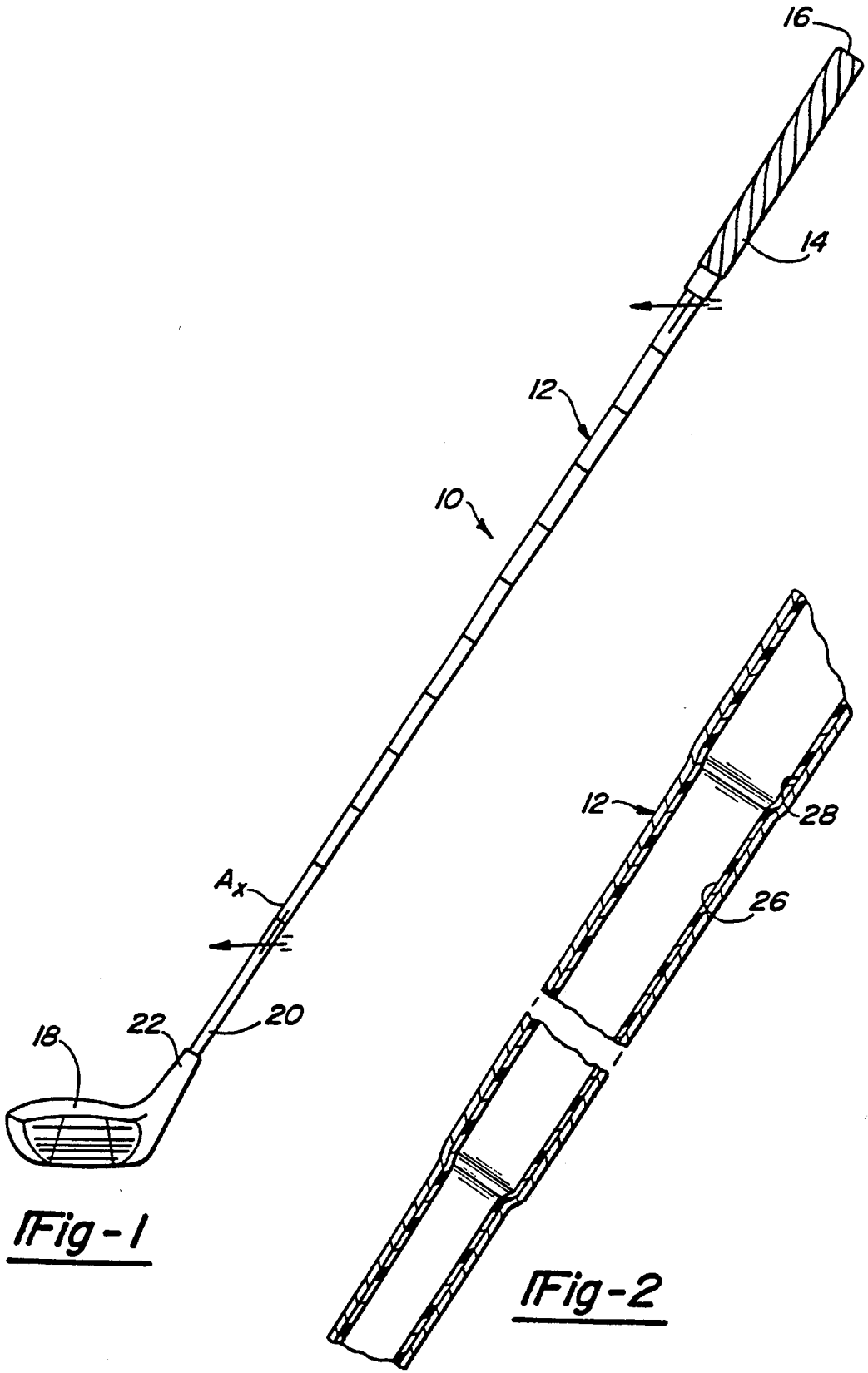
FIG. 1 is a perspective view of a golf dub including a golf club shaft having a viscoelastic damping layer in accordance with the teachings of the present invention.
FIG. 2 is a partial perspective, cross-sectional view of the shaft of FIG. 1 taken along line A—A illustrating a metallic golf club shaft including a viscoelastic damping layer disposed along a selected length of the shaft's inner surface.

A golf club incorporating any one of the number of different shafts in accordance with the teachings of the present invention is shown in FIG. 1 and is designated generally by the reference numeral 10. As shown, the golf club 10 includes a generally cylindrical shaft 12 formed along the longitudinal axis $A_x$ with a grip 14 attached at its upper end 16 and a club head 18 attached at its lower end 20. The shaft 12 is typically tapered downwardly from the upper end 16 to the lower end 20, with the lower end 20 of the shaft 12 being received within a hosel 22 of the golf club head 18 as is conventional in the art. The shaft 12 includes a damping zone (not shown in FIG. 1), indicated generally at reference numeral 24, that extends a selected length dimension along the shaft 12. As will be described in greater detail below, this so-called damping zone includes a damping layer 26 (also not shown in FIG. 1) that reduces the effects of vibrations generated and transferred upon the shaft 12.

As shown particularly in FIG. 2, the shaft 12 is fabricated as a hollow sleeve including the viscoelastic damping layer 26 applied to the inner surface 28 of the shaft 12 along the length of the shaft 12 which defines the damping zone 24.

From the outset, it should be noted that the shaft 12 can be formed from a variety of different materials, many of which are currently employed in golf shafts which are conventional in the art. By way of example, golf shafts can be made from both metallic and non-metallic materials and combinations of both metallic and non-metallic materials. By "metals," it is to be understood that alloys including one or more combinations of metallic constituents are contemplated as being useful for production of golf shafts. Among the numerous metals which are considered to be useful in the production of golf club shafts, ferrous metals such as aluminum, titanium, steel, stainless steel and tungsten are particularly useful. Additionally, certain non-ferrous metals including copper, brass, bronze, zinc, magnesium, tin and nickel may be employed generally as alloying agents.

Various non-metal materials, which are now commonly used in manufacture of golf club shafts, include resin matrix composites such as carbon fibers such as those illustrated in FIGS. 3 and 4, ceramic matrix, aramid fibers, polyethylene fibers, boron, fiberglass, and various thermoplastics including, but not limited to, polypropylene, polyethylene, polystyrene, vinyls, acrylics, nylon and polycarbonates, among others.

Composite golf club shafts, whether metallic or non-metallic, generally are provided in three different forms. The first composite form includes those structures wherein fibers are embedded in a matrix structure. A second composite form generally consists of particulate materials which are embedded in matrix structures, and still another composite form relates to laminates wherein layers of similar or dissimilar materials are employed.

While the present invention is particularly applicable when metal or metal based golf club shafts are employed, since all golf club shafts are susceptible to vibrations caused by impact to a certain extent, it should be clear to those skilled in the art that the subject invention encompasses the use of virtually any golf club shaft.

Referring now to the drawings, and more particularly to FIG. 2, a first damped golf club shaft embodiment in accordance with the teachings of the present invention is illustrated. According to FIG. 2, there is shown a club shaft 12 made from a metal such as 4140 steel. The club shaft 12 includes an inner surface designated by reference numeral 28 which is coated with damping layer 26 made from a viscoelastic material. By "viscoelastic," it is meant that the material is rubber or thermoplastic based and serves to absorb energy resulting from vibrational waves subjected upon the shaft to which it is applied.

Preferably, the viscoelastic material employed in accordance with the teaching of the present invention will have a Shore A durometer hardness of between about 30–70, and can be applied as a liquid mist as will be described in greater detail below. The density of the viscoelastic employed is preferably in the range of between about 0.5 g/cm$^3$ to about 2.5 g/cm$^3$. Ideally, the viscoelastic material is applied to a desired section of the inner surface 28 such that the resulting damping layer is in intimate surface contact with the inner surface. This intimate surface contact is a direct function of the damping efficiency of the material.

Among the numerous viscoelastic materials useful in accordance with the teachings of the present invention, certain commercially available products have proven to be particularly useful. Among the commercially available viscoelastic products which can be employed, those including vinyl based latex emulsion mastics such as DC-100 Damping Compound available from Technicon Industries, Inc., of Concord, N.C. and other products, such as AQUAPLAS DS available from H. L. Blachford, Inc., of West Chicago, Ill., have proven to be particularly useful.

The amount of viscoelastic material employed is determinative upon a number of different factors including, but not limited to, the materials used to make the shaft and the structure of the shaft itself. For example, a conventional shaft formed from seamless 4140 steel, having standard length and diameter dimensions and weighing approximately 110 grams, would typically be coated with approximately 10–20 grams of the damping material, whereas a titanium shaft having standard length and diameter dimensions and weighing between about 60 grams to 70 grams would typically employ up to 60 grams of damping material.

As a general rule, lighter weight golf club shafts, i.e. 60–70 grams for titanium, may employ more viscoelastic damping material than heavier functional weight golf club shafts, i.e. 110–120 grams for steel. This is because the total weight of any golf club shaft should be below approximately 140 grams. Golf club shafts weighing more than approximately 140 grams are typically not utilized in the golf club manufacturing industry. Thus, the amount of viscoelastic damping material employed is a balance between numerous considerations including the functional characteristics of the material and the effect on the overall weight of the shaft.

As shown in FIG. 2, a "conventional" golf club shaft would preferably include a damping layer which extends evenly over a significant length of the golf club shaft. By providing a relatively even layer of viscoelastic material, the damping layer will have a substantially non-selective damping effect on all frequencies induced by impact.

Figure 7:
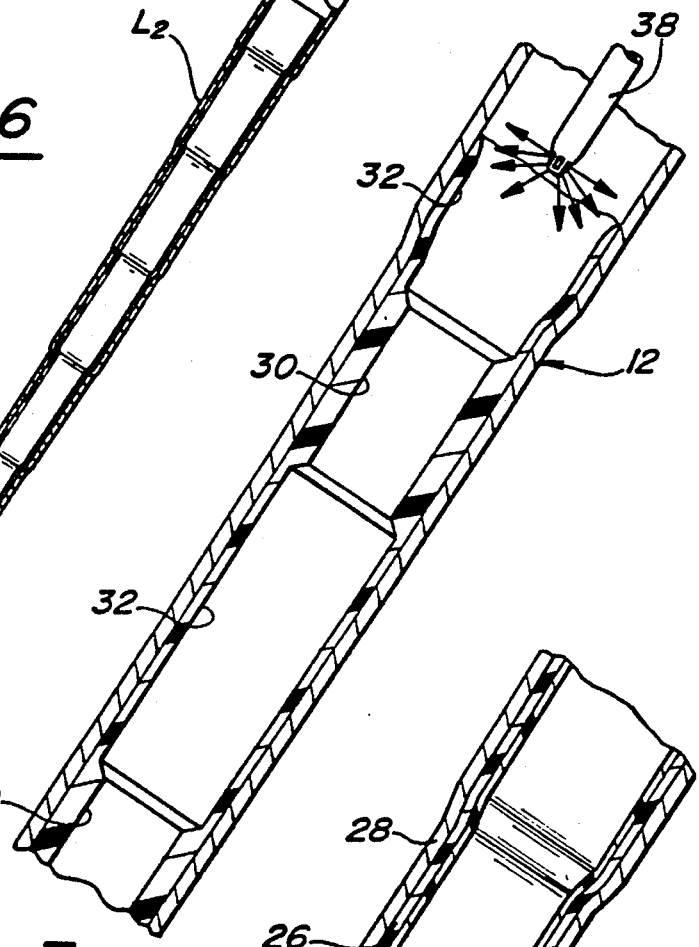
FIG. 7 is a partial perspective, cross-sectional view of an alternative shaft embodiment illustrating a damping layer occurring along a significant length of the shaft wherein the damping layer has enhanced thickness along those portions of the shaft subject to predominant vibrational modes.

With regard to the method for preparing the golf shaft illustrated in FIG. 2, the method typically includes the steps of placing a steel shaft on a spinning machine capable of rotating the shaft at a relatively constant speed. Thereafter, or prior to rotating the golf club shaft, a spraying apparatus 38 such as the one illustrated in FIG. 7, is inserted through the upper end 16 of the shaft to a point approximately six inches from the lower end 20 of the shaft. With the golf shaft spinning at a relatively constant speed, the spraying apparatus 38 is activated to disperse a mist of the desired viscoelastic material. Once the spraying begins, the spraying apparatus 38 is withdrawn at a predetermined rate in the direction of the upper end 16 of the shaft. After the desired length of the shaft's inner surface 28 has been coated with the viscoelastic material, the spraying apparatus 38 is withdrawn from the shaft. Preferably, depending upon the density of the viscoelastic material utilized, the thickness of the damping layer will, on average, range from about 0.02 inches to about 0.06 inches. Shortly after separating the spraying apparatus 38 and the shaft 12 and before the liquid viscoelastic material has a chance to settle, the shaft 12 is positioned inside an induction coil (not shown) which is heated to approximately 200° F. to rapidly cure the viscoelastic material.

Referring to FIG. 5, there is shown an alternative golf club shaft embodiment commonly referred to in the industry as one which is "tip weak." According to the embodiment illustrated in FIG. 5, the shaft includes a shaft segment $L_1$ located along the lower end 20 of the shaft 12 which has an average wall thickness which is less than the average wall thickness for the remainder of the shaft. The so-called tip weak shafts are designed to provide for added loft of the club face upon impact with the golf ball.

The damping layer 26 is disposed along this shaft segment $L_1$ from a point A, located approximately 0.15 inches from the lower end, to a point B, which is approximately 10.5 inches from the upper end of the shaft. Depending upon the density of the viscoelastic material chosen, the thickness of the coating will preferably range from 0.09 inches to about 0.26 inches on average.

Figure 6:
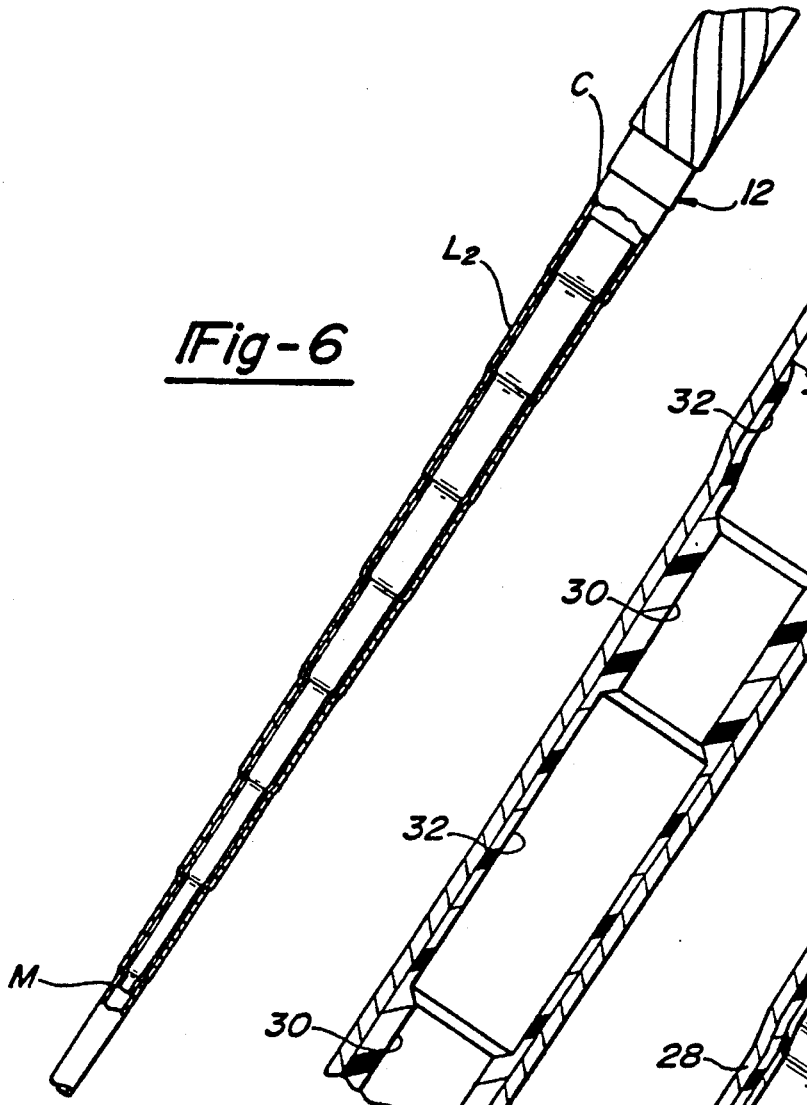
FIG. 6 is a partial perspective, cross-sectional view of an alternative shaft embodiment illustrating a damping layer located along the upper end of the shaft.

Referring to FIG. 6, there is shown an alternative golf club shaft embodiment commonly referred to in the industry as one which is "butt weak." According to the embodiment illustrated in FIG. 6, the butt weak shaft includes a shaft segment $L_2$ located along the upper end of the shaft which has an average wall thickness which is less than the average wall thickness for the remainder of the shaft. Under this embodiment, the viscoelastic material is coated substantially evenly from the approximate midpoint, M on the shaft to a point, C located approximately 10.5 inches from the upper end of the shaft 12. Again, depending upon the density of the viscoelastic material utilized for the damping layer, the average thickness of the material vary from between about 0.07 inches to about 0.21 inches. Both the embodiments of FIGS. 5 and 6 are preferably processed in a manner similar to the one described with references to FIG. 2, excepting the location of the damping layer.

Referring to FIG. 7, still another golf club shaft in accordance with the teachings of the present invention is shown. The golf club shaft 12 as shown in FIG. 7 is provided with a damping layer 26 located along a predetermined length of the shaft which includes alternating portions of thicker and thinner areas, 30 and 32 respectively, of viscoelastic material.

Utilizing a finite element method analysis, it can be determined where shaft deflections, i.e. excessive vibrational wave modes, tend to occur along the length of the shaft. With this information, the application of the viscoelastic material can be controlled such that thicker portions 30 of the damping material are applied at the locations which are subject to the most deflection. For further information on finite method analysis techniques, reference can be made to the McGraw-Hill Encyclopedia of Science & Technology, 6th Edition, Vol. 7.

Figure 11:
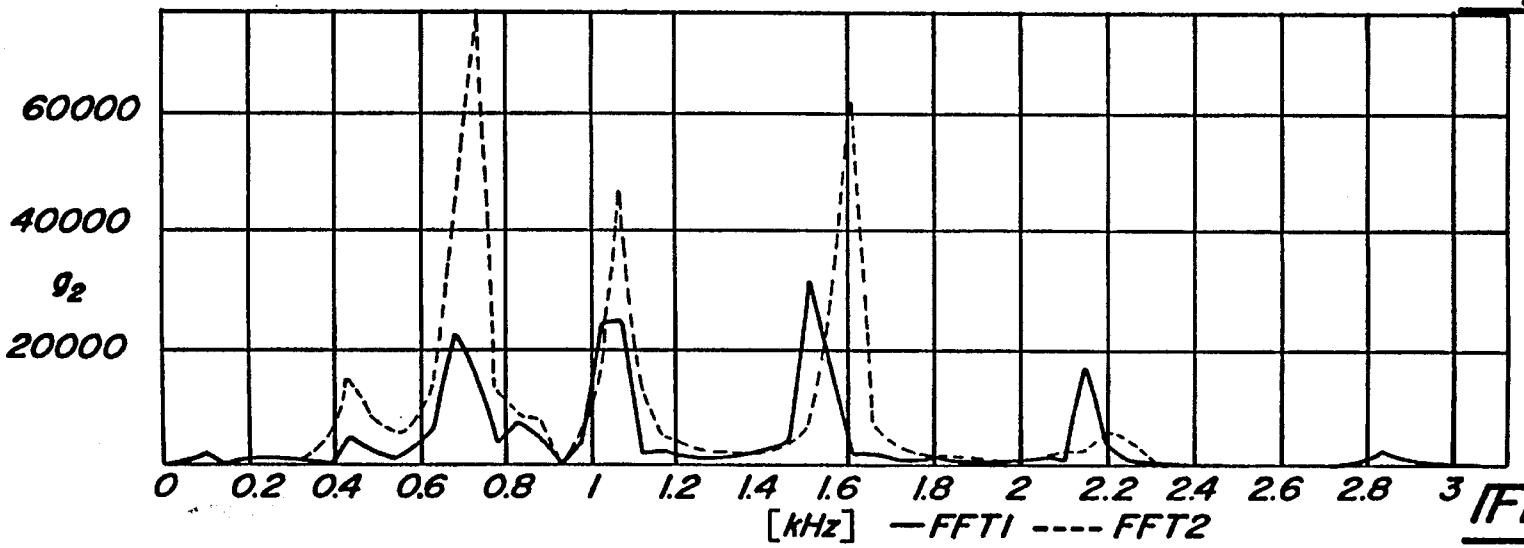
FIG. 11 is a graph illustrating various shaft deflection points occurring along discrete points of the shaft produced by means of the finite element method utilizing a computer.

A graph is depicted at FIG. 11, which illustrates the results of a dynamic analysis of the impact for a 4140 steel shaft. As can be seen upon review of the graph, significant concentrations of vibrational modes tend to occur at various points along the length of the club shaft. Thus, by determining the areas which are typically subjected to the highest concentration of vibrational waves, the spraying apparatus 38 can be controlled to distribute additional quantities of viscoelastic material at these points either by increasing the volume flow or slowing down the rate of withdrawal, or both. Typically, the thicker portions 30 will have an average thickness of no more than 0.20 inches.

Figure 10:
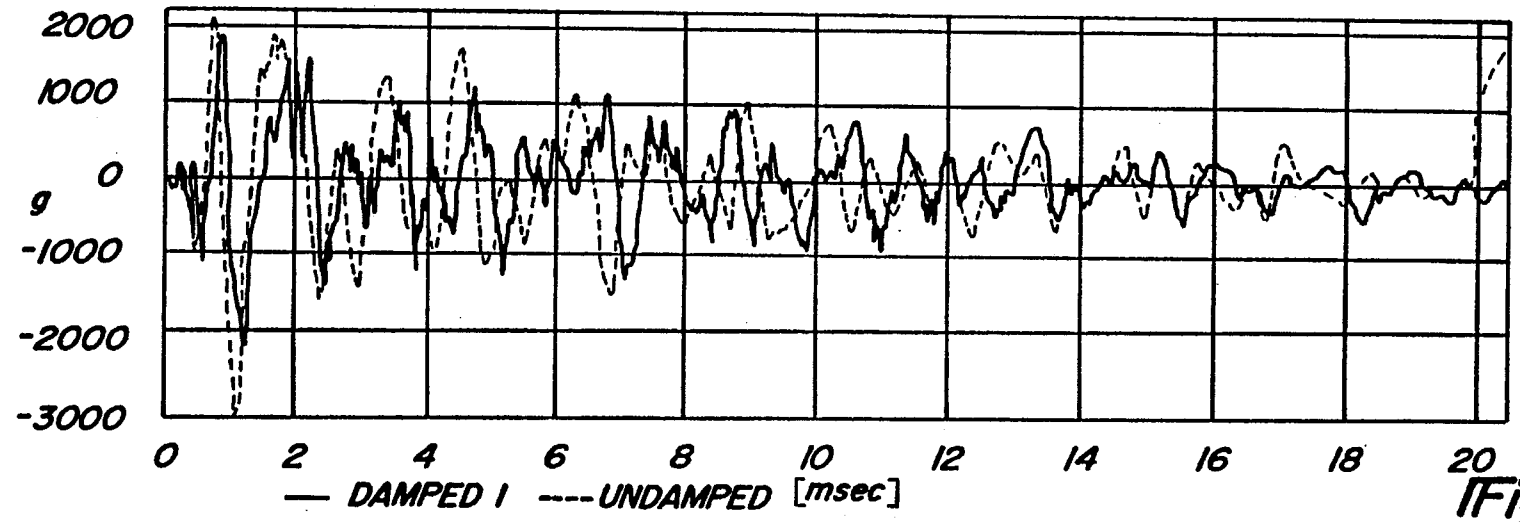
FIG. 10 is a graph illustrating a comparison of the energy dissipated in damped versus undamped steel shafts at a specified frequencies.

As illustrated in FIGS. 10 and 11, the effects of reducing the amplitude of vibrational waves utilizing the viscoelastic damping layer 26 in a steel 4140 golf club shaft versus an undamped identical steel golf club shaft is clearly demonstrated. As seen in FIG. 10, the amplitude of the vibrational waves over the same period of time is significantly greater for the undamped (shown in dot and dash) than for the damped golf club shaft (shown in solid lines).

Additionally, as illustrated in graph designated as FIG. 11, the energy dissipated by the golf club shaft, i.e. absorbed by the shaft itself, is greatly reduced through the use of the damping layer as described herein, thus, offering a better "feel" to the golf club.

Figure 8:
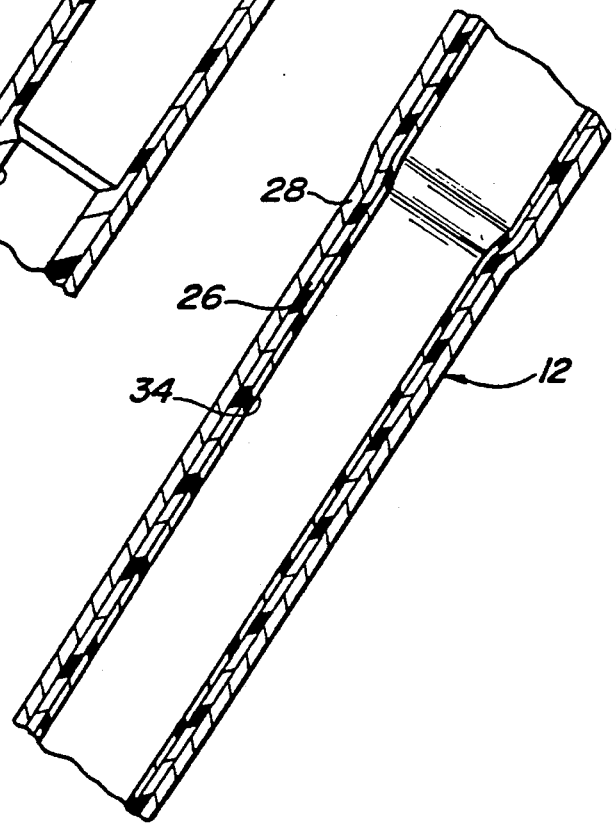
FIG. 8 is a partial perspective, cross-sectional view of an alternative shaft embodiment illustrating a damping zone defined by multiple layers of damping material.
Figure 9:
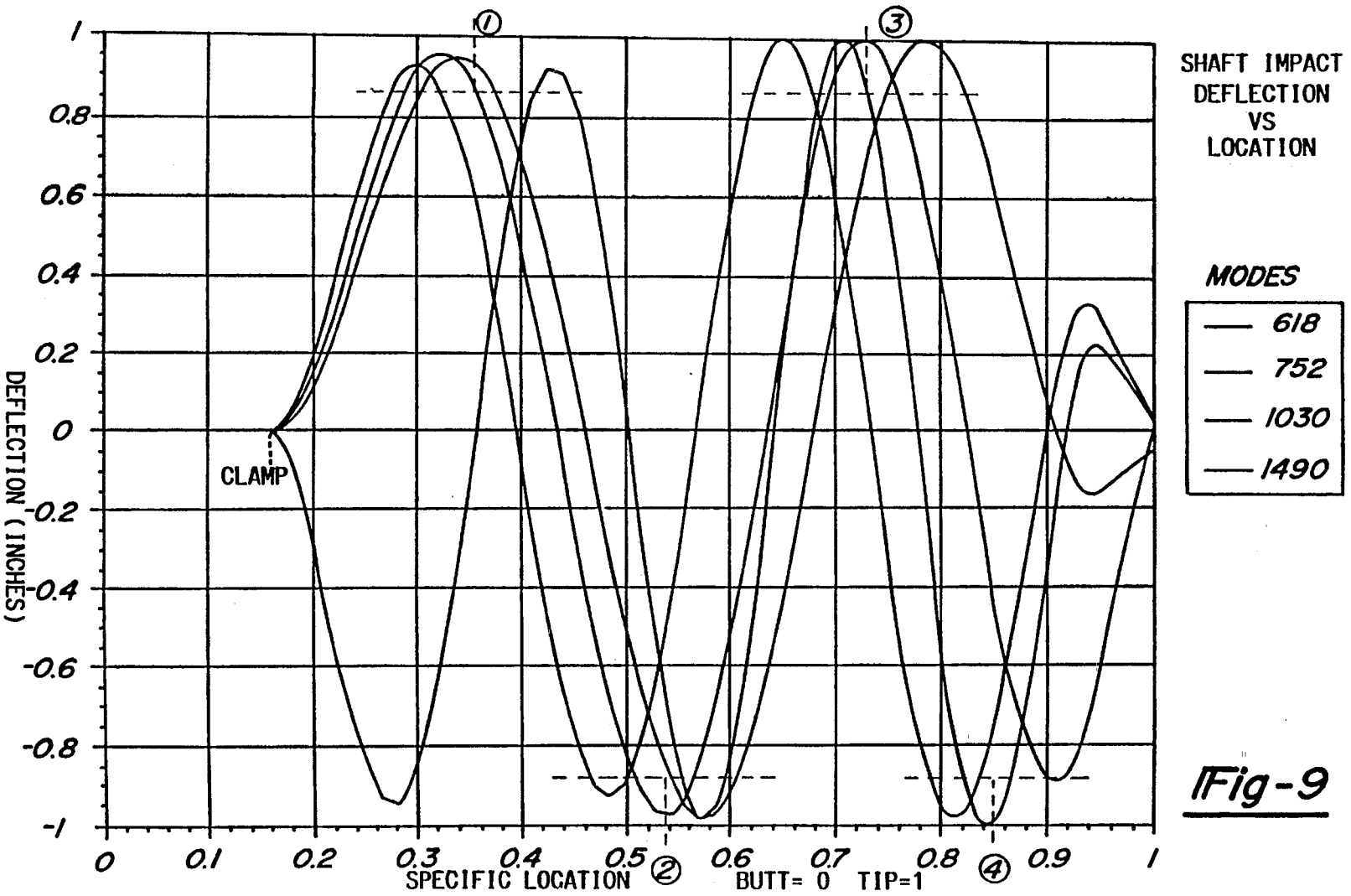
FIG. 9 is a graph illustrating the data of acceleration versus time analysis taken along the grip portion of a club during impact for both damped and undamped steel shafts.

Referring to FIG. 8, there is shown yet another alternative golf club shaft embodiment 12 wherein the damping layer 26 includes a first layer of viscoelastic material, as previously defined, disposed contiguously against the inner surface 28 of the golf club shaft. In addition, a second layer of elastomeric material 34 is disposed over the first layer. The second layer of material 34 preferably is stiffer, i.e. less elastic than the first layer and has a density in the range of 0.5 g/cm$^3$ to about 2.5 g/cm$^3$.

By providing a second layer of stiffer elastomeric material, a "constrained" layer dampening system is accomplished. By "constrained," it is meant that the damping layer is sandwiched between the inner surface of a portion of the shaft and the second layer of stiffer elastomeric material. As the substrate surface, i.e. inner surface of the golf club shaft, deforms flexurally, the damping layer is subjected to shear deformation. The shear deformation essentially provides an additional energy dissipating mechanism.

While the so-called "constrained" layer damping system is illustrated with particular reference to FIG. 8, it should be understood by those skilled in the art that a multiple layer or "constrained" layer system can be employed in any of the embodiments illustrated in FIGS. 2 through 7.

As will be apparent to those skilled in the art, various changes and modifications may be made to the illustrated damped golf club shafts of the present invention without departing from the spirit and scope of the invention as determined in the appended claims and their legal equivalent.

We claim:

1. A golf club shaft, which is attached along one end to a club head and along a second end accommodates a grip, said shaft being susceptible to multiple frequency modes of vibration upon said club head contacting a golf ball, said golf club shaft comprising:

a hollow elongated sleeve having an inner surface and an outer surface; and an elastomeric damping layer formed from a coating material applied directly to said inner surface of said sleeve along a selected length thereof;

whereby said damping layer effects a reduction in any extentional vibration wave transmitted along the shaft.

2. The golf club shaft of claim 1, wherein said elastomeric damping layer has a Shore A durometer hardness of between about 30 to about 70.

3. The golf club shaft of claim 2, wherein said elastomeric damping layer has a density of between about 0.5 g/cm$^3$ to about 2.5 g/cm$^3$.

4. The golf club shaft of claim 3, wherein said elastomeric damping layer has a substantially even thickness.

5. The golf club shaft of claim 4, wherein said substantially even thickness includes an average thickness of less than about 0.35 inch.

6. The golf club shaft of claim 3, wherein said elastomeric damping layer has a substantially uneven thickness.

7. The golf club shaft of claim 6, wherein said uneven thickness includes intermittent portions having an enhanced thickness.

8. The golf club shaft as in any of the preceding claims, further comprising a second layer of polymeric material disposed over said elastomeric damping layer, said layer of polymeric material having a hardness upon curing equal to or greater than said elastomeric layer.

9. A method for reducing the amplitude of induced modes of vibration upon a hollow metallic golf club shaft including an inner and outer surface, comprising the steps of:

rotating said shaft at a relatively constant rate of speed;

applying a liquid mist including elastomeric material to a selected length of said inner surface while said shaft is being rotated; and curing said elastomeric material by subjecting the golf club shaft including the elastomeric material to heat at elevated temperatures;

whereby upon curing said elastomeric material, a damping layer is provided along a selected length of the inner surface of said shaft, said damping layer effectively reducing any extentional vibration waves transmitted along the shaft.

10. The method according to claim 9, wherein the step of curing said elastomeric material involves the step of placing said shaft in contact with an induction coil.

11. The method according to claim 9 comprising the further step of applying a layer of polymeric material over said layer of elastomeric material.

12. A golf club shaft comprising:

a hollow elongated sleeve having an inner surface and an outer surface;

an elastomeric damping layer formed from a coating material applied directly to a selected length of said inner surface of said sleeve; and a layer of polymeric material applied over said elastomeric damping layer, said layer of polymeric material having a hardness upon curing equal to or greater than said elastomeric damping layer.

13. The golf club shaft of claim 12, wherein said elastomeric damping layer has a density of between about 0.5 $g/cm^3$ to about 2.5 $g/cm^3$.

14. The golf club shaft of claim 13, wherein said elastomeric damping layer has a substantially even thickness.

15. The golf club shaft of claim 14, wherein said substantially even thickness includes an average thickness of less than about 0.35 inch.

16. The golf club shaft of claim 14, wherein said elastomeric damping layer has a substantially uneven thickness.

17. The golf club shaft of claim 16, wherein said uneven thickness includes intermittent portions having an enhanced thickness.

* * * * *

UNITED STATES PATENT AND TRADEMARK OFFICE

CERTIFICATE OF CORRECTION

PATENT NO. : 5,607,364

DATED : March 4, 1997

INVENTOR(S) : Michael W. Hedrick et al.

It is certified that error appears in the above-indentified patent and that said Letters Patent is hereby corrected as shown below:

On the Title Page, in the "Abstract", line 5, "diameter" should be --surface--.

Signed and Sealed this

Twenty-ninth Day of July, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. :5,607,364
DATED :March 4, 1997
INVENTOR(S) :Hedrick, et al

It is certified that error appears in the above-identified patent and that said Letters Patent is hereby corrected as shown below:

On the Title Page, item [73], after "Assignee", "Black & Decker Inc.,' should read -- Emhart Inc., --

Signed and Sealed this

Twenty-second Day of September, 1998

*Attest:*

BRUCE LEHMAN

*Attesting Officer*

*Commissioner of Patents and Trademarks*